US011640740B2

(12) United States Patent
Jang et al.

(10) Patent No.: US 11,640,740 B2
(45) Date of Patent: May 2, 2023

(54) AUTOMATED TELLER MACHINE AND MEDIUM CONVEYANCE ROUTE SWITCHING DEVICE FOR AUTOMATED TELLER MACHINE

(71) Applicant: HYOSUNG TNS INC., Seoul (KR)

(72) Inventors: Hyun Soo Jang, Gyeonggi-do (KR); Tae Gang Kim, Gyeonggi-do (KR); Sung Ho Park, Seoul (KR); Hye Bin Oh, Incheon (KR)

(73) Assignee: HYOSUNG TNS INC., Seoul (KR)

( * ) Notice: Subject to any disclaimer, the term of this patent is extended or adjusted under 35 U.S.C. 154(b) by 255 days.

(21) Appl. No.: 16/950,938

(22) Filed: Nov. 18, 2020

(65) Prior Publication Data

US 2021/0192879 A1 Jun. 24, 2021

(30) Foreign Application Priority Data

Dec. 20, 2019 (KR) ..... 10-2019-0172355

(51) Int. Cl.
*B65H 29/60* (2006.01)
*B65H 29/62* (2006.01)
(Continued)

(52) U.S. Cl.
CPC ..... *G07D 11/18* (2019.01); *B65H 29/125* (2013.01); *B65H 29/62* (2013.01); *B65H 43/02* (2013.01);
(Continued)

(58) Field of Classification Search
CPC ..... B65H 29/58; B65H 29/60; B65H 29/62; B65H 29/125; B65H 2701/1912;
(Continued)

(56) References Cited

U.S. PATENT DOCUMENTS 10,377,599 B2 * 8/2019 Chou ..... B65H 43/04
2011/0233855 A1 9/2011 Herczeg et al.
(Continued)

FOREIGN PATENT DOCUMENTS

CN 106097567 A 11/2016
DE 10 2011 109 621 A1 3/2012
(Continued)

OTHER PUBLICATIONS

Office Action and translation for corresponding Russian Patent Appln. 2020137885 filed Nov. 19, 2020.
(Continued)

*Primary Examiner* — Luis A Gonzalez
(74) *Attorney, Agent, or Firm* — Bacon & Thomas, PLLC

(57) ABSTRACT

A medium conveyance route switching device includes a support unit, a gate assembly, and a rotation mechanism. The support unit is located at a branching point of a first conveyance path, a second conveyance path and a third conveyance path where conveyance directions of a medium converge in three directions. The gate assembly includes a first to a third gate positioned on one ends of the first to the third conveyance path to guide at the branching point the medium to other conveyance paths than a conveyance path from which the medium is conveyed. The rotation mechanism includes a first actuator rotating the first gate to switch the medium conveyed from the first conveyance path to the second conveyance path or the third conveyance path, and a second actuator, when the first gate is rotated, rotating the second gate and the third gate in associated with the second gate.

9 Claims, 9 Drawing Sheets

(51) Int. Cl.

| | |
|---|---|
| ***B65H 29/58*** | (2006.01) |
| ***G07D 11/18*** | (2019.01) |
| ***G07D 7/181*** | (2016.01) |
| ***G07D 11/50*** | (2019.01) |
| ***B65H 29/12*** | (2006.01) |
| ***B65H 43/02*** | (2006.01) |
| ***G07F 19/00*** | (2006.01) |

(52) U.S. Cl.
CPC ..... *G07D 7/181* (2017.05); *G07D 11/50* (2019.01); *G07F 19/201* (2013.01); *B65H 2701/1912* (2013.01); *G07D 2207/00* (2013.01); *G07D 2211/00* (2013.01)

(58) Field of Classification Search
CPC ..... B65H 43/02; B65H 2301/3125; B65H 2301/44822; B65H 2404/63; B65H 2404/632; G07D 11/18; G07D 11/50; G07D 2207/00; G07D 2211/00; G07D 7/181; G07F 19/201
See application file for complete search history.

(56) References Cited

U.S. PATENT DOCUMENTS

| | | | | |
|---|---|---|---|---|
| 2015/0194004 | A1* | 7/2015 | Sackfield ..... | G07D 11/14 194/346 |
| 2018/0040189 | A1 | 2/2018 | Chang et al. | |
| 2022/0204301 | A1* | 6/2022 | Jang ..... | B65H 29/58 |

FOREIGN PATENT DOCUMENTS

| | | | |
|---|---|---|---|
| EP | 3422305 | A1 | 1/2019 |
| JP | 2016-098070 | A | 5/2016 |
| KR | 10-1173806 | B1 | 8/2012 |
| RU | 2189283 | C2 | 9/2002 |
| RU | 2519391 | C2 | 6/2014 |
| WO | 2015/032184 | A1 | 3/2015 |

OTHER PUBLICATIONS

Search Report and translation for corresponding Russian Patent Appln. 2020137885 filed Nov. 19, 2020.

* cited by examiner

AUTOMATED TELLER MACHINE AND MEDIUM CONVEYANCE ROUTE SWITCHING DEVICE FOR AUTOMATED TELLER MACHINE

CROSS-REFERENCE TO RELATED APPLICATION

This application is based on and claims priority from Korean Patent Application No. 10-2019-0172355, filed on Dec. 20, 2019, the disclosure of which is incorporated herein in its entirety by reference for all purposes.

TECHNICAL FIELD

The present disclosure relates to an automated teller machine and a medium conveyance route switching device for an automated teller machine. More specifically, the present disclosure pertains to a medium conveyance route switching device for an automated teller machine, which is installed in an automated teller machine to switch a conveyance direction of a medium on a conveyance path.

BACKGROUND

The automated teller machine an apparatus that allows a user to perform a deposit/withdrawal transaction of a cash or a check, an account transfer and an inquiry service without time restrictions through the use of a cash card or a bankbook issued by a financial institution. The automated teller machine is an unmanned terminal which is widely used in the financial industry because it can rapidly provide financial services to a user.

The automated teller machine may include a deposit/withdrawal part for a user to input or receive a medium for deposit or withdrawal, a conveyance path through which the medium deposited or withdrawn through the deposit/withdrawal part is conveyed, a discrimination part provided on the conveyance path to discriminate the presence or absence of an abnormality and the type of a medium, a temporary storage part in which the medium deposited through the discrimination part is temporarily stored, a rejected medium storage part configured to accommodate a medium discriminated by the discrimination part to have an abnormality, and a medium storage part configured to perform a reflux function so that the medium is received or withdrawn.

In addition, the gate provided in the conveyance path is usually formed of a blade installed to rotate about a rotation shaft at a position where the conveyance path is branched. The gate is configured so that the medium conveyed from any one conveyance path is connected to one of the remaining conveyance paths in correspondence to a deposit/withdrawal step. A medium conveyance route switching device is provided in the conveyance path so as to switch a medium conveyance route to a plurality of other conveyance routes in each deposit/withdrawal step.

The conventional medium conveyance route switching device, e.g., Korean Patent Registration No. 10-1173806 (published on Aug. 16, 2016), is usually composed of a triangular blade rotatably installed at a position where three conveyance paths are branched. The conventional medium conveyance route switching device is configured so that the medium conveyed from any one conveyance path is connected to one of the remaining two conveyance paths in correspondence to a deposit/withdrawal step.

However, in the conventional medium conveyance route switching device, the installation space of an actuator for driving the blade occupies a relatively large space. This may make it difficult to arrange components inside the device in a space saving manner.

In addition, the conventional medium conveyance route switching device is limited to the conveyance paths branched in three directions and, therefore, may not be able to actively cope with an increasing trend in the branching direction of the conveyance path due to diversified cassette arrangement.

SUMMARY

Embodiments of the present disclosure provide an automated teller machine and a medium conveyance route switching device for an automated teller machine, which are capable of accurately and rapidly changing a conveyance direction of a medium at the time of depositing or withdrawing the medium.

Furthermore, embodiments of the present disclosure provide an automated teller machine and a medium conveyance route switching device for an automated teller machine, which are capable of reducing an installation space of an actuator for driving a gate and consequently realizing space-intensive arrangement of components in the device. In addition, embodiments of the present disclosure provide an automated teller machine and a medium conveyance route switching device for an automated teller machine, which are capable of increasing the branching directions of a conveyance path in conformity with the diversified medium cassette arrangement.

In accordance with an embodiment of the present disclosure, there is provided a medium conveyance route switching device for an automated teller machine, including: a support unit located at a branching point of a first conveyance path, a second conveyance path and a third conveyance path where conveyance directions of a medium converge in three directions; a gate assembly including a first gate, a second gate and a third gate positioned on one ends of the first conveyance path, the second conveyance path and the third conveyance path, respectively, to guide at the branching point the medium to other conveyance paths among the first conveyance path, the second conveyance path and the third conveyance path than a conveyance path from which the medium is conveyed; and a rotation mechanism configured to rotate the first gate, the second gate and the third gate, wherein the rotation mechanism includes: a first actuator configured to rotate the first gate to switch the medium conveyed from the first conveyance path to the second conveyance path or the third conveyance path; and a second actuator configured to, when the first gate is rotated, rotate the second gate and the third gate in associated with the second gate so that the second conveyance path and the third conveyance path become open or close.

The first gate may be configured to guide the medium conveyed from the first conveyance path to the second conveyance path or the third conveyance path, the second gate may be configured to guide the medium conveyed from the second conveyance path to the first conveyance path or the third conveyance path, and the third gate may be configured to guide the medium conveyed from the third conveyance path to the first conveyance path or the second conveyance path.

The first gate may include a first rotation shaft rotatably mounted to the support unit and a plurality of first gate pieces disposed on one side of the first rotation shaft, the first gate pieces being spaced apart from each other along a longitudinal direction of the first rotation shaft, the second gate may include a second rotation shaft rotatably mounted to the support unit and a plurality of second gate pieces disposed on one side of the second rotation shaft, the second gate pieces being spaced apart from each other along a longitudinal direction of the second rotation shaft, and the third gate may include a third rotation shaft rotatably mounted to the support unit and a plurality of third gate pieces disposed on one side of the third rotation shaft, the third gate pieces being spaced apart from each other along a longitudinal direction of the third rotation shaft.

The rotation mechanism may further include a driving gear configured to operatively connect the third rotation shaft and the second actuator, and a driven gear configured to operatively connect the second rotation shaft and the driving gear.

The driving gear and the driven gear may be engaged with each other so that the second gate pieces and the third gate pieces rotate in opposite rotation directions.

The support unit may include: a first support piece having a first through-hole portion; a second support piece having a second through-hole portion, wherein one side wall of the second support piece remains in contact with one side wall of the first support piece; a third support piece having a third through-hole portion, wherein one side wall of the third support piece remains in contact with another side wall of the second support piece and another side wall of the first support piece; and a fixing shaft configured to extend through the first through-hole portion, the second through-hole portion and the third through-hole portion to fix the first support piece, the second support piece and the third support piece.

The support unit may be provided in an assembly form in which the first support piece, the second support piece and the third support piece are alternately arranged with respect to the first gate, the second gate and the third gate along a longitudinal direction of the fixing shaft.

The first support piece, the second support piece and the third support piece may be arranged symmetrically to each other with the fixing shaft interposed therebetween.

The first actuator may be operatively connected to one end of the first gate, and the second actuator may be located on the other end side of the first gate so as to be operatively connected to the second gate and the third gate. In accordance with an embodiment of the present disclosure, there is provided an automated teller machine, including: a conveyance path configured to provide conveyance routes for a medium to be deposited and withdrawn through a deposit/withdrawal part; a medium conveyance route switching device described above configured to guide a moving direction of the medium at a branching point of the conveyance path where the conveyance routes are branched; and a discrimination part installed on the conveyance path to discriminate the presence or absence of an abnormality and the type of the medium.

According to the embodiments of the present disclosure, it is possible to accurately and rapidly change a conveyance direction of a medium at the time of depositing or withdrawing the medium through the use of a simple structure.

Furthermore, according to the embodiments of the present disclosure, it is possible to reduce an installation space of an actuator for driving a gate and consequently realize space-intensive arrangement of components in the device.

In addition, according to the embodiments of the present disclosure, it is possible to increase the branching directions of a conveyance path in conformity with the diversified medium cassette arrangement.

Moreover, according to the embodiments of the present disclosure, it is possible to perform switching in conformity with various switching angles between conveyance paths, which makes it possible to cope with various switching angles compared with a conventional triangular single blade gate.

DETAILED DESCRIPTION

Figure 1:
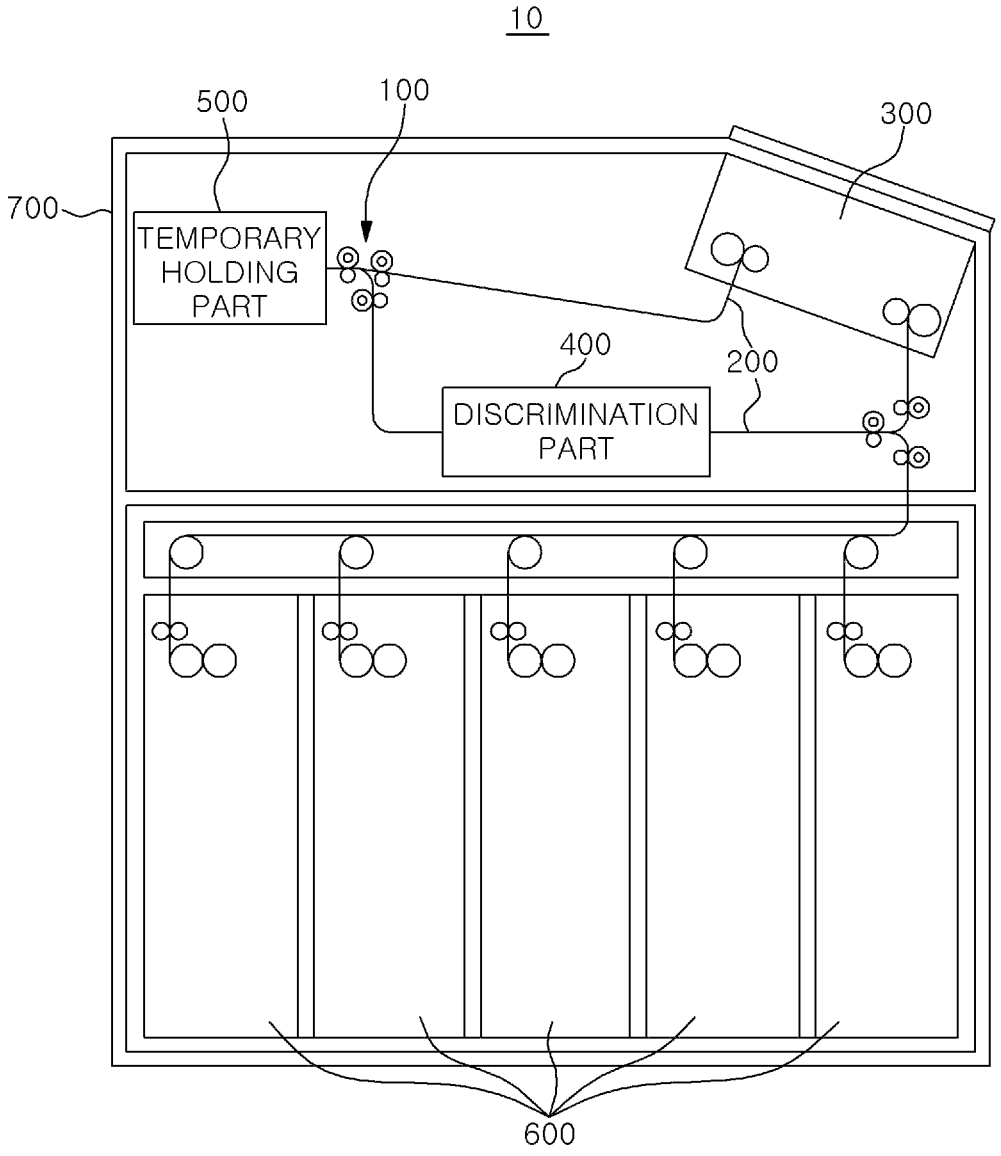
FIG. 1 is a block diagram schematically showing an automated teller machine provided with a medium conveyance route switching device according to one embodiment of the present disclosure.

Hereinafter, configurations and operations of embodiments will be described in detail with reference to the accompanying drawings. The following description is one of various patentable aspects of the present disclosure and may form a part of the detailed description of the present disclosure.

However, in describing the present disclosure, detailed descriptions of known configurations or functions that make the present disclosure obscure may be omitted.

The present disclosure may be modified and include various embodiments. Specific embodiments will be exemplarily illustrated in the drawings and described in the detailed description of the embodiments. However, it should be understood that they are not intended to limit the present disclosure to specific embodiments but rather to cover all modifications, similarities, and alternatives that are included in the spirit and scope of the present disclosure.

The terms used herein, including ordinal numbers such as "first" and "second" may be used to describe, and not to limit, various components. The terms simply distinguish the components from one another.

When it is said that a component is "connected" or "linked" to another component, it should be understood that the former component may be directly connected or linked to the latter component or a third component may be interposed between the two components.

Specific terms in the present disclosure are used simply to describe specific embodiments without limiting the present disclosure. An expression used in the singular encompasses the expression of the plural, unless it has a clearly different meaning in the context.

Hereinafter, a medium conveyance route switching device for an automated teller machine according to one embodiment of the present disclosure will be described with reference to the accompanying drawings.

FIG. 1 is a block diagram schematically showing an automated teller machine provided with a medium conveyance route switching device according to one embodiment of the present disclosure.

As shown in FIG. 1, the automated teller machine 10 according to one embodiment of the present disclosure may include a frame/housing 700, a deposit/withdrawal part 300, a conveyance path 200, a medium conveyance route switching device 100, a discrimination part 400, a temporary holding part 500, and a reflux cassette 600.

The frame/housing 700 may provide a storage space for storing a medium. In this embodiment, the frame/housing 700 is not limited to a storage space of a medium (a bank note, a check, etc.). The frame/housing 700 may provide the overall appearance of the automated teller machine.

The deposit/withdrawal part 300 may provide a deposit/withdrawal space for inputting or receiving a medium. The deposit/withdrawal part 300 may be provided with belts, rollers, motors and the like for conveying the medium. Configurations of the belts, the rollers, the motors and the like are generally known in the art of medium conveyance and, therefore, the detailed description thereof will be omitted.

The conveyance path 200 may provide a medium conveyance path in the internal space of the frame/housing 700. The conveyance path 200 may provide a conveyance route of a medium to be deposited and withdrawn through the deposit/withdrawal part 300. For example, the conveyance path 200 may guide the medium deposited through the deposit/withdrawal part 300 to the discrimination part 400, the temporary holding part 500 or the reflux cassette 600, or may guide the medium discharged from the reflux cassette 600 to the discrimination part 400 or the deposit/withdrawal part 300.

The medium conveyance route switching device 100 may be installed on the conveyance path 200. The medium conveyance route switching device 100 may branch the conveyance path so that the moving direction of the medium is guided. Details of the medium conveyance route switching device 100 will be described later.

The discrimination part 400 may be installed on the conveyance path 200. The discrimination part 400 may discriminate the type and the presence or absence of abnormality of the medium passing through the conveyance path 200. At the time of depositing and counting the medium, the normal medium discriminated as a medium having no abnormality by the discrimination part 400 may be temporarily stored in the temporary holding part 500. The suspected medium discriminated as a media having an abnormality by the discrimination part 400 may be returned to the customer through the deposit/withdrawal part 300.

The temporary holding part 500 may provide a storage space for temporarily storing the medium discriminated by the discriminating part 400. The temporary holding part 500 may receive the medium discriminated by the discrimination part 400 through the conveyance path 200.

The reflux cassette 600 may provide a stacking space capable of storing a medium during deposition. The reflux cassette 600 may discharge the medium stored in the stacking space during withdrawal. The reflux cassette 600 may include a plurality of cassettes having different sizes depending on the type of a medium.

The configuration of the automated teller machine 10 described above is exemplified to help understanding of the present embodiment. Accordingly, other configurations may be added to the above-described configuration as needed. The configuration and structure may be modified or changed according to the needs.

Figure 2:
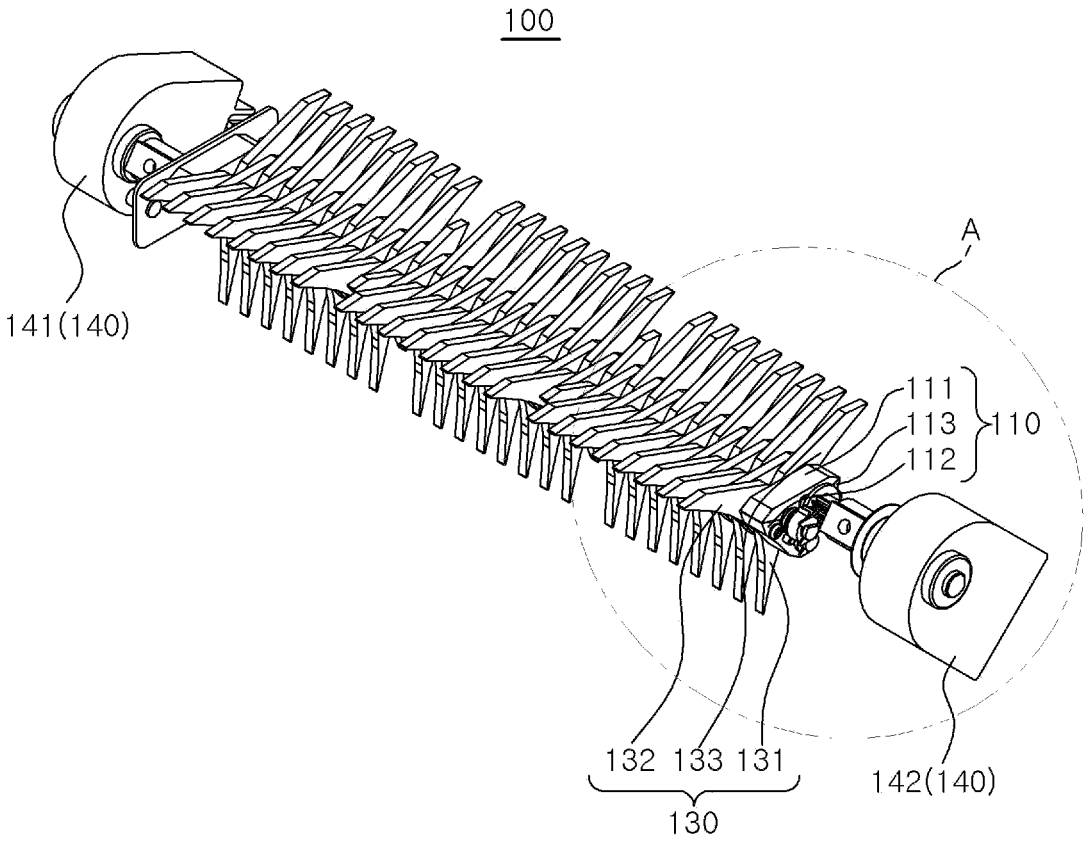
FIG. 2 is a perspective view showing the medium conveyance route switching device of the automated teller machine according to one embodiment of the present disclosure.
Figure 3:
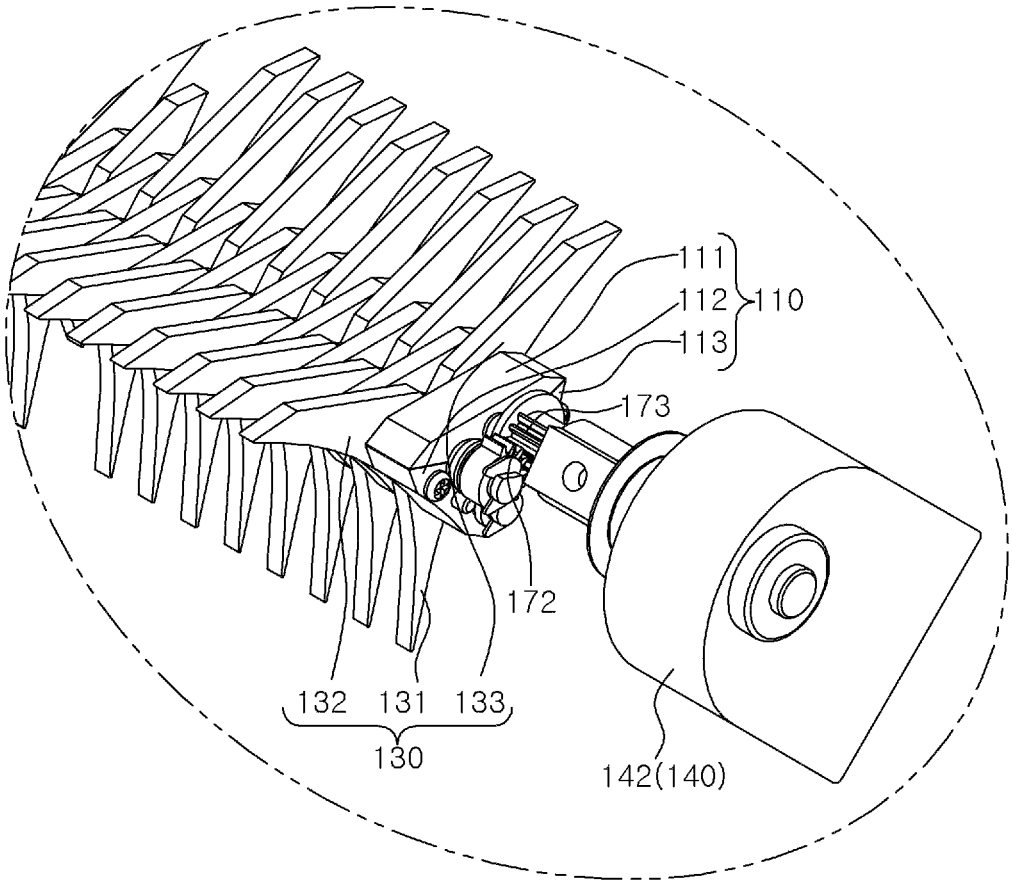
FIG. 3 is an enlarged perspective view illustrating a region "A" in FIG. 2.
Figure 4:
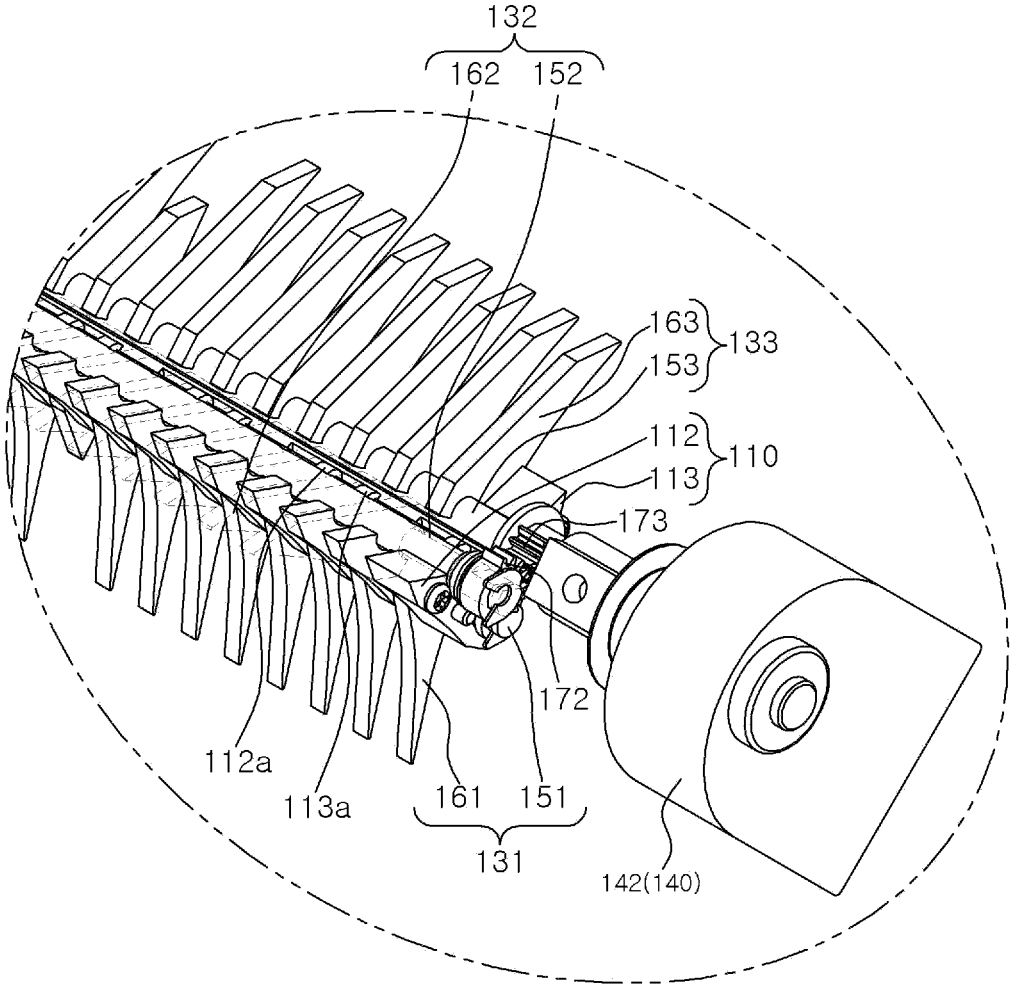
FIG. 4 is an enlarged perspective view in which the first support piece shown in FIG. 3 is removed.
Figure 5:
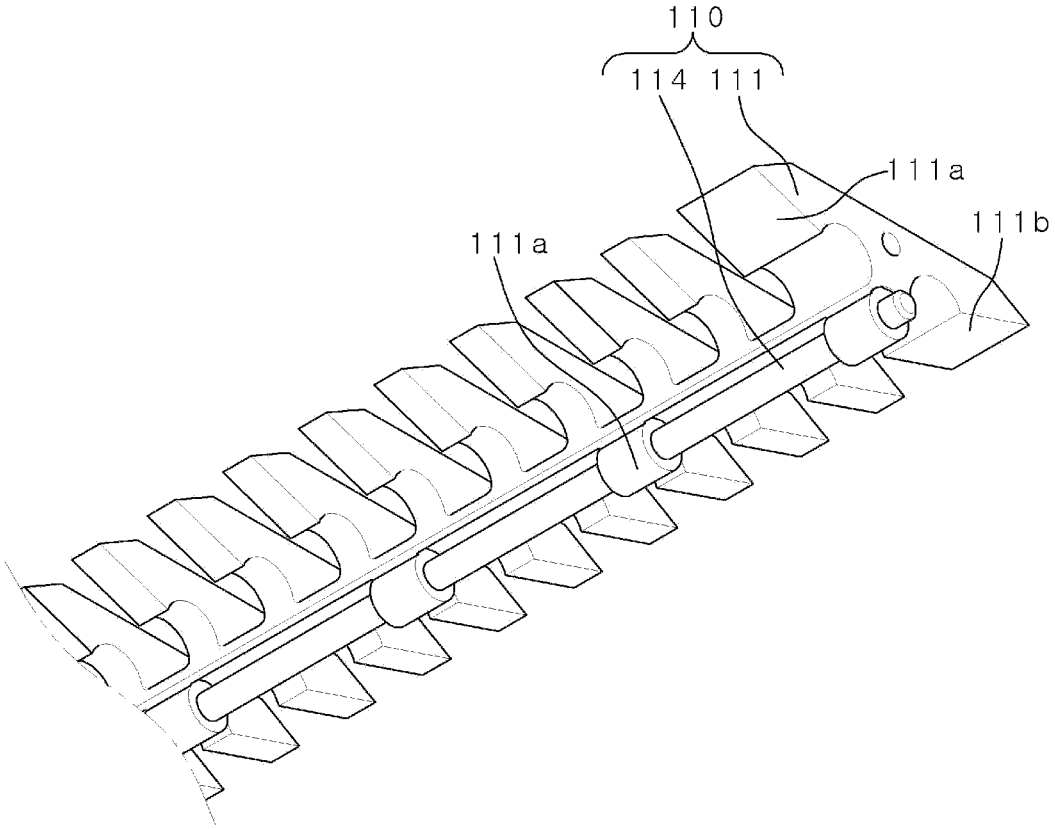
FIG. 5 is a perspective view showing the back side of the first support piece removed from FIG. 3.
Figure 6:
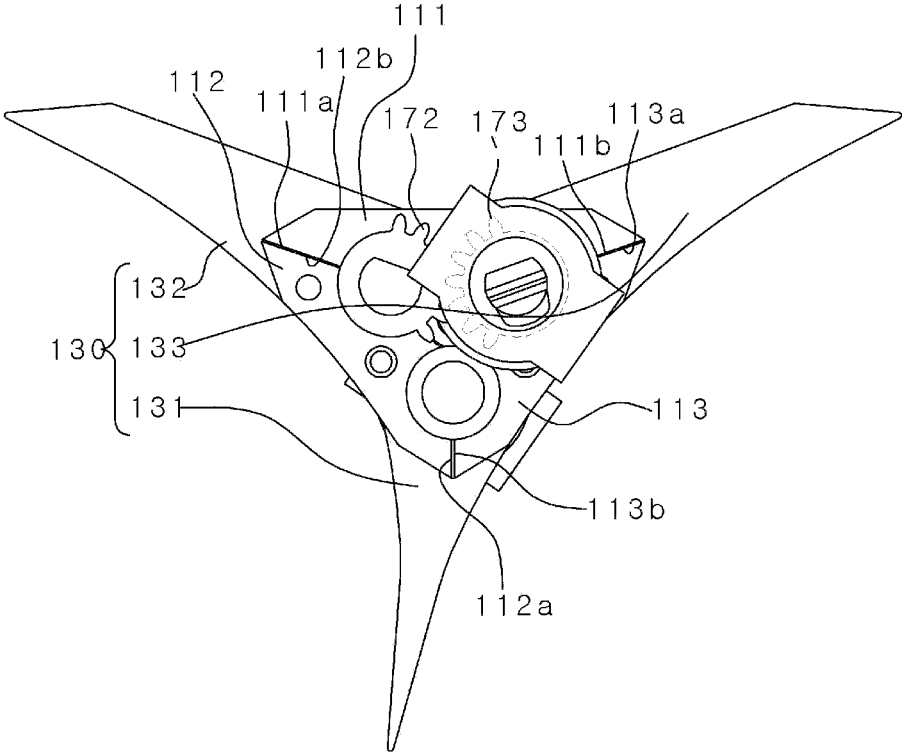
FIG. 6 is a front view showing the medium conveyance route switching device of the automated teller machine according to one embodiment of the present disclosure.

FIG. 2 is a perspective view showing the medium conveyance route switching device of the automated teller machine according to one embodiment of the present disclosure. FIG. 3 is an enlarged perspective view illustrating a region "A" in FIG. 2. FIG. 4 is an enlarged perspective view in which the first support piece shown in FIG. 3 is removed. FIG. 5 is a perspective view showing the back side of the first support piece removed from FIG. 3. FIG. 6 is a front view showing the medium conveyance route switching device of the automated teller machine according to one embodiment of the present disclosure.

As shown in FIGS. 2 to 6, the medium conveyance route switching device 100 according to one embodiment of the present disclosure may include a support unit 110 located at a branching point where conveyance routes converge in three directions, a gate assembly 130 configured to guide a medium to different conveyance paths at the branching point, and a rotation mechanism 140 configured to rotate a first gate 131, a second gate 132 and a third gate 133.

Specifically, the support unit 110 may be located at a branching point of the conveyance path 200 where conveyance routes of the medium converge in three directions. The medium conveyed on the conveyance path 200 may be supported by a guide roller 710. In the case of the three-way conveyance path 200, for the sake of convenience and understanding of the description, the conveyance path located on the lower side in the drawings is defined as a first conveyance path 201, the conveyance path located on the left side in the drawings is defined as a second conveyance path 202, and the conveyance path located on the right side in the drawings is defined as a third conveyance path 203. The support unit 110 may be located at a point where the conveyance path 200 is branched into switching paths 120 (see FIG. 7).

The support unit 110 may include a first support piece 111, a second support piece 112, a third support piece 113 and a fixing shaft 114. The first support piece 111 may be provided as an inverted triangle piece as a whole. Side walls 111*a* and 111*b* of the first support piece 111 may be in close contact with the side wall 112*b* of the second support piece 112 and the side wall 113*a* of the third support piece 113, respectively. A first through-hole portion 111*a* may be formed at a lower edge portion of the first support piece 111.

Side walls 112*a* and 112*b* of the second support piece 112 may be in close contact with the side wall 111*a* of the first support piece 111 and the side wall 113*b* of the third support piece 113, respectively. A second through-hole portion 112*a* may be formed at a side edge portion of the second support piece 112.

Side walls 113*a* and 113*b* of the third support piece 113 may be in close contact with the side wall 112*a* of the second support piece 112 and the side wall 111*b* of the first support piece 111, respectively. A third through-hole portion 113*a* may be formed at a side edge portion of the third support piece 113. The fixing shaft 114 penetrates through the first through-hole portion 111*a*, the second through-hole portion 112*a* and the third through-hole portion 113*a* to fix the first support piece 111, the second support piece 112 and the third support piece 113.

The first support piece 111, the second support piece 112 and the third support piece 113 may be disposed symmetrically to each other with the fixing shaft 114 interposed therebetween. The first support piece 111, the second support piece 112 and the third support piece 113 may be provided in a plural number and may be alternately arranged with respect to the first gate piece 161, the second gate piece 162 and the third gate piece 163 of the gate assembly 130 along the longitudinal direction of the fixing shaft 114.

The gate assembly 130 may guide the moving direction of the medium conveyed on the three-way conveyance path 200. To this end, the gate assembly 130 may include a plurality of gates that are rotatably installed on the support unit 110. Since one end of each of the gates is rotated at a point where the conveyance path 200 is branched into the switching paths 120, the other end of each of the gates can selectively open or close each of the switching paths 120.

The gate assembly 130 includes a first gate 131, a second gate 132 and a third gate 133 located on the side of the first conveyance path 201, the second conveyance path 202 and the third conveyance path 203, respectively.

The first gate 131 may guide the conveyance direction of the medium from the first conveyance path 201 to the second conveyance path 202 or the third conveyance path 203. The first gate 131 may include a first rotation shaft 151 rotatably mounted to the support unit 110, and a plurality of first gate pieces 161 spaced apart along the longitudinal direction on one side of the first rotation shaft 151. The first rotation shaft 151 is a rotation axis of the first gate 131 and may be rotatably installed on a lower portion of the support unit 110.

The second gate 132 may guide the conveyance direction of the medium from the second conveyance path 202 to the first conveyance path 201 or the third conveyance path 203. The second gate 132 may include a second rotation shaft 152 rotatably mounted to the support unit 110, and a plurality of second gate pieces 162 spaced apart along the longitudinal direction on one side of the second rotation shaft 152. The second rotation shaft 152 is a rotation axis of the second gate 132 and may be rotatably installed on one side portion of the support unit 110.

The third gate 133 may guide the conveyance direction of the medium from the third conveyance path 203 to the first conveyance path 201 or the second conveyance path 202. The third gate 133 may include a third rotation shaft 153 rotatably mounted to the support unit 110, and a plurality of third gate pieces 163 spaced apart along the longitudinal direction on one side of the third rotation shaft 153. The third rotation shaft 153 is a rotation axis of the third gate 133 and may be rotatably installed on the other side portion of the support unit 110.

The rotation mechanism 140 may include a first actuator 141 configured to rotate the first rotation shaft 151, a second actuator 142 configured to rotate the second rotation shaft 152 and the third rotation shaft 153 together, a driving gear 173 configured to operatively connect the third rotation shaft 153 and the second actuator 142, and a driven gear 172 configured to operatively connect the second rotation shaft 152 and the driving gear 173.

The first actuator 141 may rotate the first rotation shaft 151 clockwise or counterclockwise in the drawings, whereby the moving direction of the medium moved through the first conveyance path 201 can be guided to the second conveyance path 202 or the third conveyance path 203.

When the first rotation shaft 151 is rotated, the second actuator 142 may rotate the second rotation shaft 152 and the third rotation shaft 153 together. At this time, the second rotation shaft 152 and the third rotation shaft 153 are engaged with each other through the driving gear 173 and the driven gear 172. Therefore, if one of the second gate 132 or the third gate 133 is rotated by the second actuator 142, the second gate 132 and the third gate 133 may be rotated together.

For example, when the second actuator 142 rotates the third rotation shaft 153 clockwise, the second rotation shaft 152 may be simultaneously rotated counterclockwise by receiving a rotational force through the driving gear 173 and the driven gear 172. In the present embodiment, the second actuator 142 is operatively connected to the third rotation shaft 153 via the driving gear 173. However, the present disclosure is not limited thereto. The second actuator 142 may be operatively connected to the second rotation shaft 152 through the driving gear 173.

The driving gear 173 may operatively connect the end of the third rotation shaft 153 and the driving shaft of the second actuator 142. Furthermore, the driving gear 173 may engage the driven gear 172. The driven gear 172 may be provided at the end of the second rotation shaft 152 so as to engage with the driving gear 173. Since the driving gear 173 and the driven gear 172 are engaged in a gear-to-gear meshing manner, if the second rotation shaft 152 and the third rotation shaft 153 are rotated by the driving gear 173 and the driven gear 172, the second gate piece 162 and the third gate piece 163 may be rotated in opposite rotation directions.

Hereinafter, the operation of the medium conveyance route switching device according to one embodiment of the present disclosure will be described.

Figure 7:
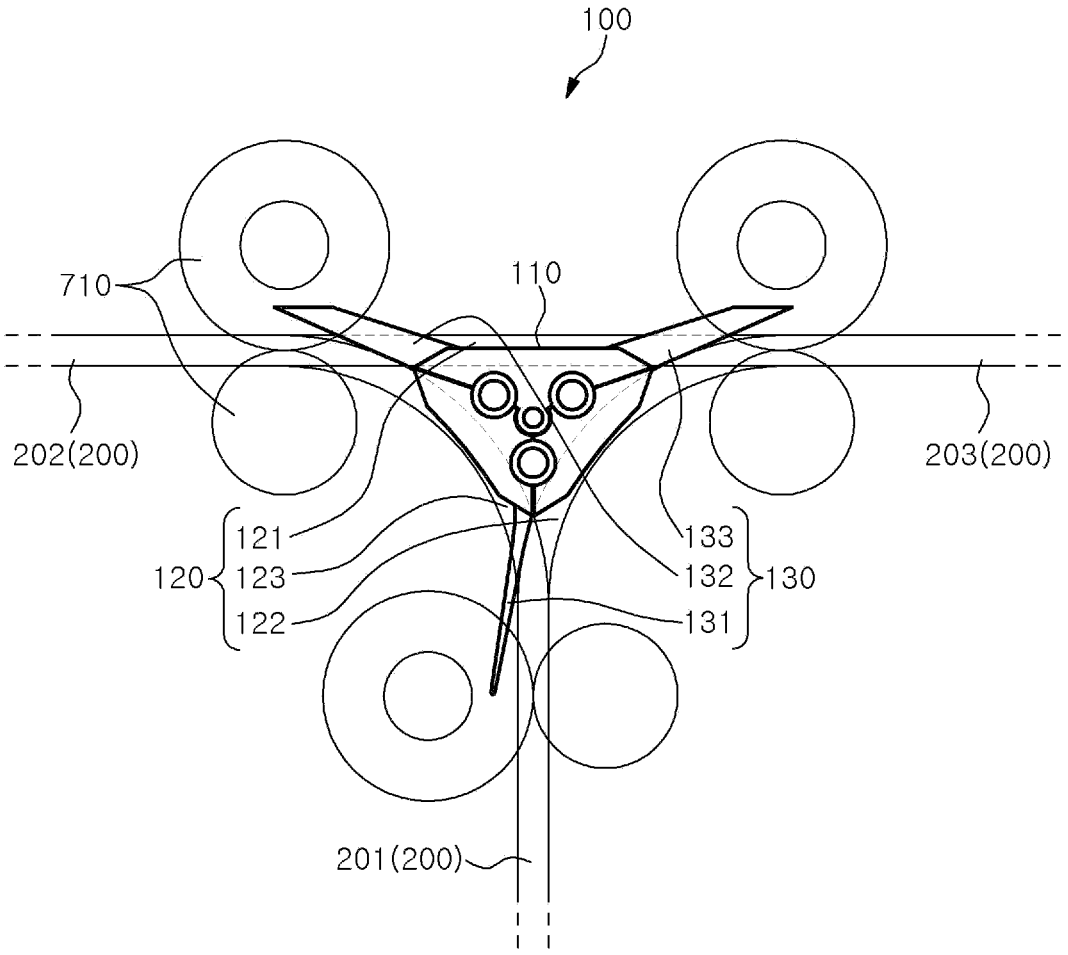
FIGS. 7 to 9 are operation state diagrams showing the operation state of FIG. 6 at the branching point of the conveyance path.
Figure 8:
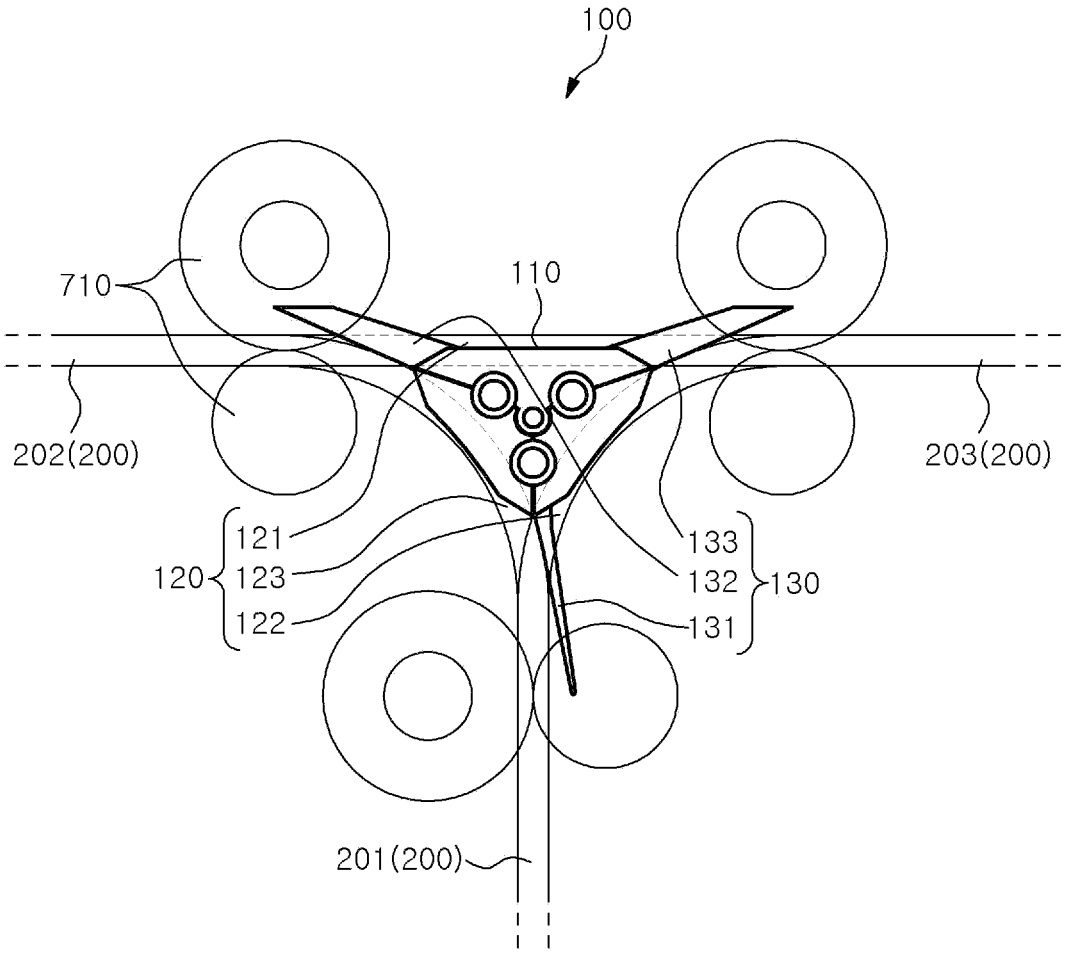
Figure 9:
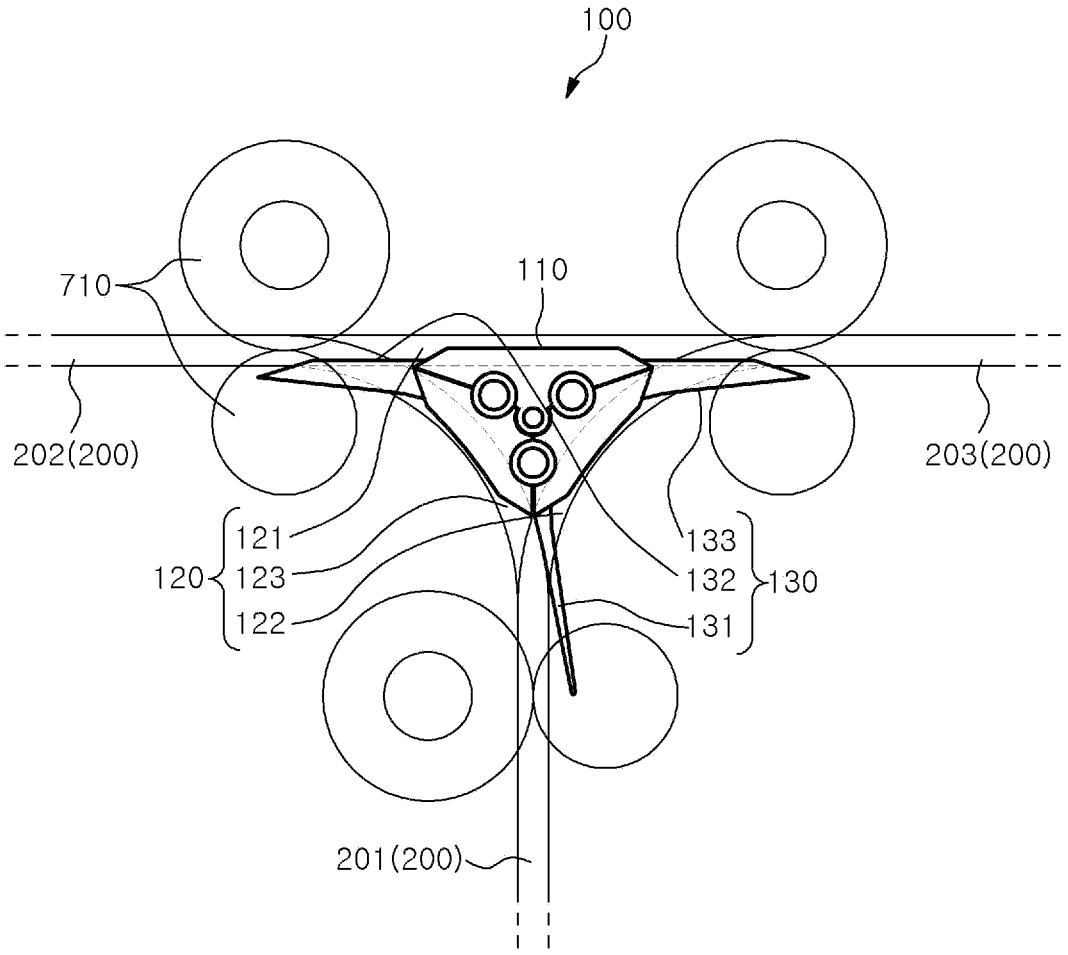

FIGS. 7 to 9 are operation state diagrams showing the operation state of FIG. 6 at the branching point of the conveyance path.

First, as illustrated in FIGS. 7 to 9, a plurality of branched switching paths 120 may be provided on the conveyance path 200 in order to guide the medium moved along the conveyance path 200 in one direction to the conveyance path 200 in the other direction. For example, the plurality of switching paths 120 may include a first switching path 121, a second switching path 122 and a third switching path 123 that interconnect the three-way conveyance paths 200.

The first switching path 121 may connect the second conveyance path 202 and the third conveyance path 203. The second switching path 122 may connect the first conveyance path 201 and the third conveyance path 203. The third switching path 123 may connect the first conveyance path 201 and the second conveyance path 202. At this time, the first conveyance path 201 may be branched into the second switching path 122 and the third switching path 123. The second conveyance path 202 may be branched into the first switching path 121 and the third switching path 123. The third conveyance path 203 may be branched into the first switching path 121 and the second switching path 122.

For example, as shown in FIG. 7, when the first actuator 141 rotates the first rotation shaft 151 clockwise in FIG. 7 and the second actuator 142 rotates the third rotation shaft 153 counterclockwise in FIG. 7, the first gate 131 and the third gate 133 may open the second switching path 122. Accordingly, the medium moved through the first conveyance path 201 may be guided to the third conveyance path 203 through the second switching path 122, or the medium moved through the third conveyance path 203 may be guided to the first conveyance path 201 through the second switching path 122.

As shown in FIG. 8, when the first actuator 141 rotates the first rotation shaft 151 counterclockwise in FIG. 8 and the second actuator 142 rotates the third rotation shaft 153 counterclockwise in FIG. 8, the second rotation shaft 152 is rotated clockwise in FIG. 8 together with the third rotation shaft 153, so that the first gate 131 and the second gate 132 can open the third switching path 123. Accordingly, the medium moved through the first conveyance path 201 may be guided to the second conveyance path 202 through the third switching path 123, or the medium moved through the second conveyance path 202 may be guided to the first conveyance path 201 through the third switching path 123.

As shown in FIG. 9, when the second actuator 142 rotates the third rotation shaft 153 clockwise in FIG. 9, the second rotation shaft 152 is rotated counterclockwise in FIG. 9 together with the third rotation shaft 153. Therefore, the second gate 132 and the third gate 133 may open the first switching path 121. Accordingly, the medium moved through the second conveyance path 202 is guided to the third conveyance path 203 through the first switching path 121, or the medium moved through the third conveyance path 203 may be guided to the second conveyance path 202 through the first switching path 121.

As described above, the present disclosure provides a structure capable of accurately and rapidly changing the conveyance direction of the medium at the time of depositing or withdrawing the medium. It is possible to reduce the installation space of the actuator for driving the gate and consequently realize space-intensive arrangement of components in the device. It is possible to increase the branching directions of the conveyance path in conformity with the diversified medium cassette arrangement.

While the present disclosure has been described above using the preferred embodiments, the scope of the present disclosure is not limited to the specific embodiments described above. A person having ordinary knowledge in the relevant technical field will be able to replace or modify the constituent elements. Such replacement or modification should be construed to fall within the scope of the present disclosure.

What is claimed is:

1. A medium conveyance route switching device for an automated teller machine, comprising:

a support unit located at a branching point of a first conveyance path, a second conveyance path and a third conveyance path where conveyance directions of a medium converge in three directions;

a gate assembly including a first gate, a second gate and a third gate positioned on one ends of the first conveyance path, the second conveyance path and the third conveyance path, respectively, to guide at the branching point the medium to other conveyance paths among the first conveyance path, the second conveyance path and the third conveyance path than a conveyance path from which the medium is conveyed; and a rotation mechanism configured to rotate the first gate, the second gate and the third gate, wherein the rotation mechanism includes:

a first actuator configured to rotate the first gate to switch the medium conveyed from the first conveyance path to the second conveyance path or the third conveyance path; and a second actuator configured to, when the first gate is rotated, rotate the second gate and the third gate in associated with the second gate so that the second conveyance path and the third conveyance path become open or close, and wherein the support unit includes:

a first support piece having a first through-hole portion;

a second support piece having a second through-hole portion, wherein one side wall of the second support piece remains in contact with one side wall of the first support piece;

a third support piece having a third through-hole portion, wherein one side wall of the third support piece remains in contact with another side wall of the second support piece and another side wall of the first support piece; and a fixing shaft configured to extend through the first through-hole portion, the second through-hole portion and the third through-hole portion to fix the first support piece, the second support piece and the third support piece.

2. The medium conveyance route switching device of claim 1, wherein the first gate is configured to guide the medium conveyed from the first conveyance path to the second conveyance path or the third conveyance path, the second gate is configured to guide the medium conveyed from the second conveyance path to the first conveyance path or the third conveyance path, and the third gate is configured to guide the medium conveyed from the third conveyance path to the first conveyance path or the second conveyance path.

3. The medium conveyance route switching device of claim 1, wherein the first gate includes a first rotation shaft rotatably mounted to the support unit and a plurality of first gate pieces disposed on one side of the first rotation shaft, the first gate pieces being spaced apart from each other along a longitudinal direction of the first rotation shaft, the second gate includes a second rotation shaft rotatably mounted to the support unit and a plurality of second gate pieces disposed on one side of the second rotation shaft, the second gate pieces being spaced apart from each other along a longitudinal direction of the second rotation shaft, and the third gate includes a third rotation shaft rotatably mounted to the support unit and a plurality of third gate pieces disposed on one side of the third rotation shaft, the third gate pieces being spaced apart from each other along a longitudinal direction of the third rotation shaft.

4. The medium conveyance route switching device of claim 3, wherein the rotation mechanism further includes a driving gear configured to operatively connect the third rotation shaft and the second actuator, and a driven gear configured to operatively connect the second rotation shaft and the driving gear.

5. The medium conveyance route switching device of claim 4, wherein the driving gear and the driven gear are engaged with each other so that the second gate pieces and the third gate pieces rotate in opposite rotation directions.

6. The medium conveyance route switching device of claim 1, wherein the support unit is provided in an assembly form in which the first support piece, the second support piece and the third support piece are alternately arranged with respect to the first gate, the second gate and the third gate along a longitudinal direction of the fixing shaft.

7. The medium conveyance route switching device of claim 6, wherein the first support piece, the second support piece and the third support piece are arranged symmetrically to each other with the fixing shaft interposed therebetween.

8. The medium conveyance route switching device of claim 1, wherein the first actuator is operatively connected to one end of the first gate, and the second actuator is located on the other end side of the first gate so as to be operatively connected to the second gate and the third gate.

9. An automated teller machine, comprising:

a conveyance path configured to provide conveyance routes for a medium to be deposited and withdrawn through a deposit/withdrawal part;

the medium conveyance route switching device of claim 1, configured to guide a moving direction of the medium at a branching point of the conveyance path where the conveyance routes are branched; and a discrimination part installed on the conveyance path to discriminate the presence or absence of an abnormality and the type of the medium.

* * * * *